US009518364B2

(12) United States Patent
Heiskanen et al.

(10) Patent No.: US 9,518,364 B2
(45) Date of Patent: Dec. 13, 2016

(54) WET LAID SHEET MATERIAL OF A MICROFIBRILLATED MATERIAL COMPOSITION

(71) Applicant: Stora Enso OYJ, Helsinki (FI)

(72) Inventors: Isto Heiskanen, Imatra (FI); Nina Ruhoniemi, Imatra (FI); Vesa Lepisto, Imatra (FI); Jouni Tuomela, Imatra (FI); Susanna Tapio, Imatra (FI); Toni Jurvanen, Imatra (FI); Petri Suhonen, Imatra (FI)

(73) Assignee: Stora Enso OYJ, Helsinki (FI)

( * ) Notice: Subject to any disclaimer, the term of this patent is extended or adjusted under 35 U.S.C. 154(b) by 0 days.

(21) Appl. No.: 14/651,737

(22) PCT Filed: Dec. 11, 2013

(86) PCT No.: PCT/IB2013/060791

§ 371 (c)(1),
(2) Date: Jun. 12, 2015

(87) PCT Pub. No.: WO2014/091413

PCT Pub. Date: Jun. 19, 2014

(65) Prior Publication Data

US 2015/0315747 A1 Nov. 5, 2015

(30) Foreign Application Priority Data

Dec. 14, 2012 (SE) ..... 1251427

(51) Int. Cl.

| | |
|---|---|
| ***D21H 11/18*** | (2006.01) |
| ***D21H 27/10*** | (2006.01) |
| ***D21H 21/14*** | (2006.01) |
| ***D21F 11/00*** | (2006.01) |
| ***A47L 13/16*** | (2006.01) |
| ***D21H 27/00*** | (2006.01) |
| ***D21H 17/67*** | (2006.01) |

(52) U.S. Cl.
CPC ..... *D21H 27/10* (2013.01); *A47L 13/16* (2013.01); *D21F 11/00* (2013.01); *D21H 11/18* (2013.01); *D21H 17/675* (2013.01); *D21H 21/14* (2013.01); *D21H 27/002* (2013.01)

(58) Field of Classification Search
CPC ..... D21H 11/18; D21H 17/67
USPC ..... 162/181.2, 100, 158, 205
See application file for complete search history.

(56) References Cited

U.S. PATENT DOCUMENTS

| | | | |
|---|---|---|---|
| 4,443,297 | A | 4/1984 | Cheshire et al. |
| 6,670,521 | B2 | 12/2003 | Noda et al. |
| D602,675 | S | 10/2009 | Österman |
| 2003/0000665 | A1 | 1/2003 | Takai et al. |
| 2004/0216853 | A1 | 11/2004 | Fornas |
| 2005/0087317 | A1 | 4/2005 | Rydell |
| 2009/0035340 | A1 | 2/2009 | Landa et al. |
| 2010/0024998 | A1 | 2/2010 | Wildlock et al. |
| 2010/0279019 | A1 | 11/2010 | Beck et al. |
| 2011/0268777 | A1 | 11/2011 | Marsh et al. |
| 2012/0090119 | A1 | 4/2012 | Carrier et al. |
| 2012/0291974 | A1 | 11/2012 | Kajanto |

FOREIGN PATENT DOCUMENTS

| | | |
|---|---|---|
| CN | 1252109 | 5/2000 |
| CN | 1282395 | 1/2001 |
| CN | 101040084 | 9/2007 |
| CN | 102066663 | 5/2011 |
| CN | 102686799 | 9/2012 |
| CN | 102791924 | 11/2012 |
| CN | 103025813 | 4/2013 |
| CN | 103142176 | 6/2013 |
| EP | 2688701 | 9/2012 |
| FI | 112623 | 12/1998 |
| FI | 20021490 | 2/2004 |
| GB | 1329409 | 9/1973 |
| JP | H05279985 | 10/1993 |
| WO | 9620701 | 7/1996 |
| WO | 02085272 | 10/2002 |
| WO | 2009021687 | 2/2009 |
| WO | 2010142845 | 12/2010 |
| WO | 2011004300 | 1/2011 |
| WO | 2011080386 | 7/2011 |
| WO | 2011110744 | 9/2011 |

OTHER PUBLICATIONS

JP H05279985, Shozaburo, Dobashi, et al., Oct. 1993, machine translation.*
Henriksson, M. et al, "Cellulose Nanopaper Structures of High Toughness," Biomacromolecules 2008, 9, pp. 1579-1585.
International Searching Authority, International Search Report, WO2014/091413, Jun. 19, 2014.
International Searching Authority, International Preliminary Report on Patentability, PCT/IB2013/060791, Jun. 16, 2015.
International Searching Authority, Written Opinion of the International Searching Authority, PCT/IB2013/060791, Mar. 20, 2014.
European Patent Office, European Search Report, PCT/IB2013/060791, Jun. 17, 2016.
Pakistan Patent Office, First Examination Report for Patent Application No. 868/2013, Jan. 23, 2015.
Pakistan Patent Office, Second Examination Report for Patent Application No. 868/2013, Oct. 27, 2015.
Chinese Patent Office, Office Action for Patent Application No. 201380073113.8, Apr. 6, 2016.
Henriksson, M., et al. "Cellulose Nanopaper Structures of High Toughness", Biomacromolecules 2008, 9, pp. 1579-1585.

* cited by examiner

*Primary Examiner* — Mark Halpern
(74) *Attorney, Agent, or Firm* — Greer, Burns & Crain, LTD

(57) ABSTRACT

A wet laid sheet material formed from a fibrous web, characterized in that the initial fibrous web contains >50% a calculated dry microfibrillated material composition by weight of the total fiber material content in the web, wherein the fibrillated material composition has a SR value of >70; and in that the moisture content in the sheet material is >30 wt.-%.

24 Claims, 5 Drawing Sheets

Fig. 1
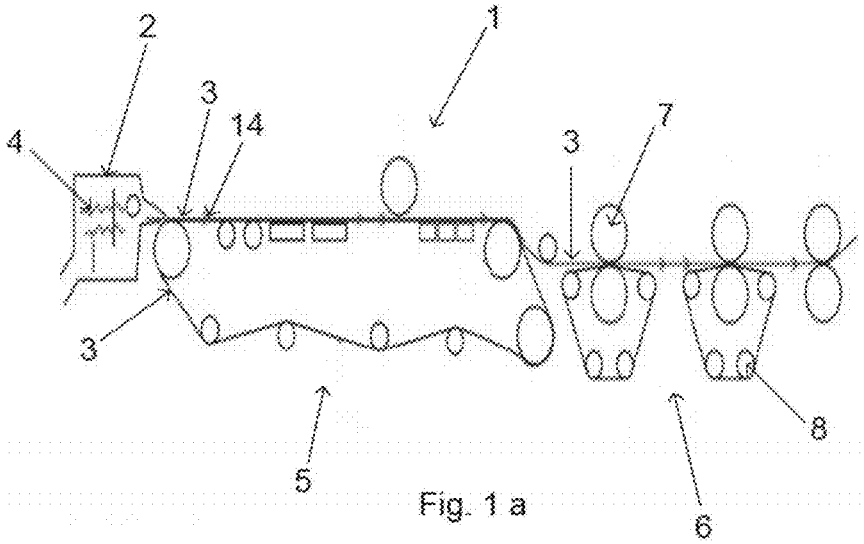
Fig. 1 a
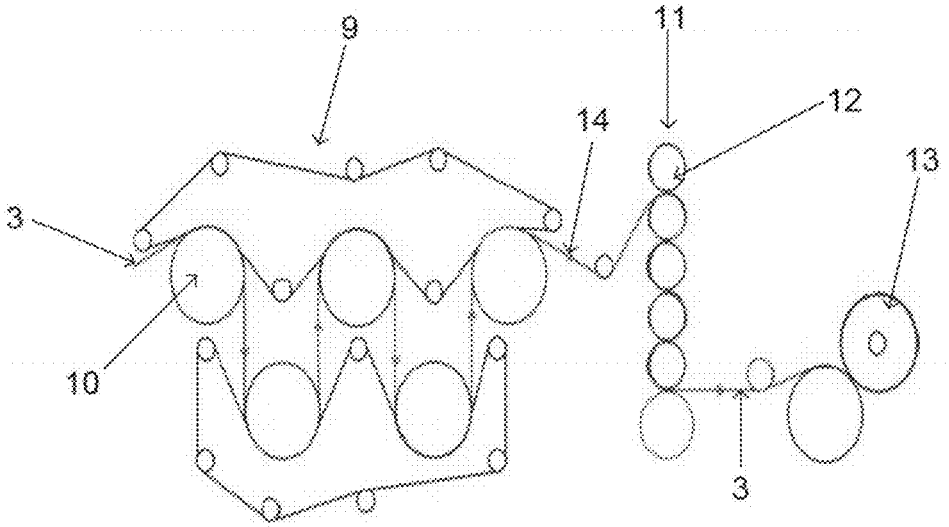
Fig. 1b

WET LAID SHEET MATERIAL OF A MICROFIBRILLATED MATERIAL COMPOSITION

This application is a U.S. National Phase under 35 U.S.C. §371 of International Application No. PCT/IB2013/060791, filed Dec. 11, 2013, which claims priority under 35 U.S.C. §§119 and 365 to Swedish Application No. 1251427-9, filed Dec. 14, 2012.

TECHNICAL FIELD

The present document relates to a wet laid sheet material of microfibrillated material composition. More particularly, the present disclosure relates to a method for forming said sheet and uses thereof.

BACKGROUND

Hygiene tissues such as wet or moist towelette, also known as a wet nap, wet towel, or a wet wipe, are usually a small moistened piece of paper or cloth that often comes folded and individually wrapped for convenience. These are used for personal hygiene, cleaning or household cleaning.

Typically, the base material is produced as air-laid paper where the fibers are carried and formed to the structure of paper by air. Manufacturing technologies include wet laid non-wovens, melt spinning webs, dry laid webs, needled felts and others. Each of these technologies may be used alone or in composite structures. These products are available in multiple fiber chemistries (cotton, wood pulp, polyester, polypropylene, nylon, etc.) and with multiple physical characteristics, further broadening the available choices.

They are moistened with water or other liquids like isopropyl alcohol depending on the applications. The paper might be treated with softeners, lotions or added perfume to get the right properties or "feeling". Air-laid paper is very bulky, porous and soft compared with normal wet-laid paper and tissue. It has good water absorption properties and is much stronger compared with normal tissue, which also makes it difficult to flush as it does not disintegrate easily, but instead may clog the sewage system.

The main characteristics for this air laid paper are that it's soft, does not scratch, it's non-linting, i.e. no dust, not static, it's strong, even when wet, and can thus be rinsed and reused. Further the material is clean, hygienic, and can be sterilized. It has a textile-like surface and drape and it can be dyed, printed, embossed, coated and made solvent resistant. There are two dry aid nonwoven methods: carding and air laid. Carding is a well-established method of forming nonwoven textile materials. Fibers are separated and aligned while going through a system of cards before being sent directly to or through a cross-lapper to a bonding technique. In air laying, an air stream is used as the vehicle for short fibers. The fibers are collected on a moving belt or perforated drum where they form a randomly oriented web. Typically, air laid webs have a lower density and higher softness than carded webs. Air laid webs offer great versatility in terms of the fibers and fiber blends that can be used. HVAC is one application where air laid materials are common.

Air-laid paper does, however, not use water as the carrying medium for the fiber, like in a normal papermaking process. Fibers are carried and formed to the structure of paper by air. The air-laid structure is isotropic. The raw material is typically long fibered softwood fluff pulp in roll form. The pulp is defibrated in a hammer mill. Defibration is the process of freeing the fibers from each other before entering the paper machine. Important parameters for dry defibration are shredding energy and knot content. Normally an air-laid paper consists of about 85% fiber. A binder must be applied as a spray or foam. Alternatively, additional fibers or powders can be added to the pulp which can then be activated and cured by heat.

Wet wipes can serve a number of household purposes such as baby wipes which may be saturated with solutions anywhere from gentle cleansing ingredients to alcohol based 'cleaners'. Of course there is a negative environmental aspect to these wet wipes in that they are usually not biodegradable, other options such as using cotton or terry cloth type of wipes involves using large amounts of water, and washing the cloth regularly. There is thus a need for a "greener" alternative.

A new concern with traditional wet wipes is also that they may in fact cause rashes, and an additive used as a preservative called methylchloroisothiazolinone or MCI has been pointed out as a cause of particular concern, in a study made by Mayo Clinic in Rochester, Minn. There is thus also a need for a wet wipe not using preservatives, which can in any way be harmful to the environment.

Today one can find even wet wipes for pet care, and of course for washing hands before or after a meal, or for other hygiene reasons. Also in toilettes is the use of wet wipes quite common.

Other types of hygiene tissues may include cleansing pads, which essentially are fiber sponges which have been previously soaked with water, alcohol and other active ingredients for a specific intended use. They are ready to use hygiene products and they are simple and convenient solutions to dispose of dirt or other undesirable elements. There are different types of cleansing pads offered by the beauty industry: make-up removing pads, anti-spot treatments and anti-acne pads that usually contain salicylic acid, vitamins, menthol and other treatments). Cleansing pads for preventing infection are usually saturated with alcohol and bundled in sterile package. Hands and instrument may be disinfected with these pads while treating wounds. Further to this there are also pain relief pads sopping with alcohol and benzocaine. These pads are good for treating minor scrapes, burns, and insect bites. They disinfect the injury and also ease pain and itching.

The issue of disposability of products is of great concern to the nonwovens industry. Landfills, incineration, multiple sewage treatment and residential septic systems are among the common choices for nonwoven product disposal today. Products targeted for the latter disposal routes, via residential and commercial toilets, are termed flushable. Current flushable products have limitations.

Dry products, such as bathroom tissue, have been designed with minimal wet strength so that the tissue can disintegrate under the agitation in the plumbing systems. They are not designed for applications where water will be encountered in use. Flushable wet wipes have high wet strengths and do not lose their strength upon disposal. These products remain intact and identifiable in the disposal system. Further there is a relatively high production costs involved in manufacturing conventional wet toweletes/wipes, and the air laid webs are usually bound with expensive binders. These conventional wet wipes also dry quickly when exposed to air, and are usually not biodegradable.

SUMMARY

It is an object of the present disclosure, to provide an improved wet sheet for different types of applications, which eliminates or alleviates at least some of the disadvantages of the prior art wet sheets The object is wholly or partially achieved by a wet sheet and a method for forming this sheet according to the appended independent claims. Embodiments are set forth in the appended dependent claims, and in the following description and drawings.

According to a first aspect of the invention there is provided a wet laid sheet material formed from a fibrous web, wherein the initial fibrous web contains >50% a calculated dry microfibrillated material composition by weight of the total fiber material content in the web, wherein the fibrillated material composition has a SR value of >70. The moisture content in the sheet material (i.e. the end product) is >30 wt.-%.

The moisture content may consist mainly of water, which provides for a product which is very advantageous from an allergenic and environmental point of view. No additives, such as those conventionally used for instance as shown in US2011/0268777, to keep the wet sheet, formed from the wet fibrous web, moist (or even wet) are thus needed. The end product sheet is thus a wet or moist product in itself.

By "initial web" is meant the web formed by the provision of a stock suspension onto the wire of a paper making machine or similar system or system based on e.g. deposition of fiber suspension on wire and then partially dewatering the said wet web. By "of the total fiber material content in the web" is meant that the fibrous material of the web to the greatest part contains microfibrillated material composition, i.e. that this is the actual stock suspension, and not that microfibrillated material has been mixed into a pulp suspension comprising conventional cellulose fibers, thus forming a wet laid sheet material comprising or consisting mainly of microfibrillated material composition and water. The web may however also comprise other materials such as fillers, process chemicals, and functional chemicals for the end products. It should also be understood that the microfibrillated material is preferably not a dry material as such but may be a never-dried type of material.

The high SR value means that the material is a microfibrillated material, such as a microfibrillated cellulose and not e.g. a highly refined pulp.

This material may have a high initial wet tensile strength, meaning that the web has excellent runnability properties in a paper making machine, even when the web is relatively wet. This means that a wet laid sheet, for subsequent uses such as wet wipes etc. can easily be formed in a conventional paper making machine.

The wet laid sheet material formed from the wet web, is able to maintain its moisture and wet properties for a long time, i.e. it is a wet or moist material. The initial wet tensile strength is very high even in low solids, which means that the material can be used for absorption of water, even though it is already wet. The stretch properties of the material is also very god, and that makes the handling of the sheet very simple, it can be rolled into large rolls, or cut into smaller pieces or compressed or pressed to different shapes and then dried.

According to an alternative embodiment the moisture content may be >40 wt.-%, or more preferred >60 wt.-%, or even more preferred >70 wt.-%.

According to another embodiment of the first aspect the initial web may contain >60%, or >70%, or >80%, or >90%, or >95%, or >97% of calculated dry micro fibrillated material composition by weight of the total fiber material content in the web.

A wet laid sheet consisting of substantially 100% MFC may thus be formed by the fibrous wet web.

The microfibrillated material composition may comprise a microfibrillated polysaccharide.

According to one embodiment the microfibrillated material composition may comprise a microfibrillated cellulose.

By this wet sheet material there is thus also provided a way of providing a high solids content MFC material to an end user of MFC, e.g. rolled up on rolls or reels, but also as sheets.

According to one alternative embodiment of the present invention at least a portion of the microfibrillated material composition may consist of a microfibrilliated polysaccharide or a microfibrillated cellulose, having a fiber length in the range of 200 to 10000 nm, or more preferably in the range of 200 to 700 nm, or even more preferably in the range of 200 to 500 nm.

Alternatively the composition may also comprise different fractions or portions having different fiber lengths, i.e. having different coarseness, depending on the desired properties of the wet sheet material. It is also conceivable that the material comprises fractions or portions having a very small fiber length, i.e. so called nanofibrillated cellulose particles, usually having a fiber length of less than 200 nm.

This means that the particle size may be in the range of 0.2-1.0 mm depending on the origin of the microfibrillated cellulose. The microfibrillated cellulose may further have a SR value of above 70, and preferably in the range of between 85 to 97. This may provide for an improved tear strength and thus runnability of the wet web, less fines which reduces dewatering problems and the longer fibrils may also provide for the possibility to pick the wet web up from wet wire (or dewatering wire), while still not having added any other fibrous materials than MFC to the stock solution.

The microfibrillated cellulose may be a never dried type of microfibrillated cellulose.

By the MFC being a never dried MFC it is possible to maintain all advantageous properties of the MFC such as high waste absorption capacity, high bonding capacity etc.

According to one embodiment of the first aspect the sheet may be formed in a paper making machine with reduced drying.

By paper making machine is meant a conventional paper making machine such as the Fourdrinier machine, and without any particular modifications to the machine. However as there is increased risk for web breaks as material is run through drying section this material is preferably produced through a machine without a drying section.

According to yet an embodiment the web or sheet may be formed in a paper making machine with substantially no drying.

This means that the end product sheet or web is still wet, i.e. has undergone reduced, very little or no drying in the paper making machine. This is also defined by the by the moisture content being more than 30% in the wet laid sheet material.

This means that the end product sheet or web may be rolled onto large rolls in a wet state or cut into appropriate sized sheets in a wet state.

According to one embodiment at least one surface active agent or polymer has been added to the initial wet web.

By adding surface active agents or polymers such as tensides, for instance by spraying onto the wet web or added into the wet end circulation of a paper making machine the initial wet strength of the web may be increased. Further the addition of surface active agents or polymers may also improve re-wetting properties and re-pulping properties of a dried wet MFC sheet. This in turn may provide for a MFC sheet which can be flushed without causing problems in the sewage system, which e.g. conventional air laid wet wipes could do when being flushed.

According to an alternative embodiment of the first aspect an alkaline earth carbonate or precursor thereof is added into the web, such that the wet laid sheet material comprises microfibrillated cellulose and said alkaline earth carbonate.

The alkaline earth carbonate may thus be added, for instance in a manner shown in WO2011/110744 A1, such that a precipitated calcium carbonate is formed onto or into the MFC fibrils. In one embodiment the alkaline earth carbonate or precursor thereof is a nanoparticle thereof, such that a nano or micro PCC is formed onto or into the MFC fibrils.

The alkaline earth carbonate may act as a filler material in the sheet.

The addition of the carbonate may improve the visual appearance, the absorption capacity for oils and other types of impurities. The addition of the carbonate may also, improve the dewatering of the sheet in wire section and also solids after pressing and thus initial wet strength.

The alkaline earth carbonate may be a calcium carbonate and wherein the sheet comprises >30 wt.-% calcium carbonate, or >35 wt.-% calcium carbonate.

By incorporating large amounts of the calcium carbonate, as a filler material, the production cost may even further be reduced. The sheet formed by incorporating these large amounts of filler shows similar properties to a pure MFC sheet.

According to a second aspect of the invention there is provided a method of forming a wet laid sheet material from a wet fibrous web in a paper machine, wherein an initial wet fibrous web contains >50% of calculated dry microfibrillated material composition by weight of the total fiber material content in the web, wherein the microfibrillated material composition has an SR value of >70, and wherein the moisture content in the sheet material is >30% wherein the method comprises the steps of:

i) providing a stock suspension containing >50% of calculated dry microfibrillated material composition by weight of the total fiber material content in the suspension, in a head box of the paper machine;

ii) supplying said stock suspension onto a first wire in a forming section of the paper machine in such a way that the initial wet web is formed;

iii) wet pressing said wet web in a press section of the paper machine, thereby forming said wet laid sheet material.

According to one embodiment of the second aspect the initial wet fibrous web may contain >60%, or >70%, or >80%, or >90%, or >95%, or >97% of calculated dry microfibrillated material composition by weight of the total fiber material content in the web, and wherein step i) comprises providing a stock suspension containing the corresponding amount of dry microfibrillated material composition by weight of the total fiber material content in the suspension.

According to another aspect the moisture content in the sheet material may be >40%, or >50%, or >60%, or >70%.

The microfibrillated material composition may comprise a microfibrillated polysaccharide.

The microfibrillated material composition may comprise a microfibrillated cellulose.

According to one embodiment of the second aspect at least a portion of the microfibrillated material composition may consist of a microfibrilliated polysaccharide or a microfibrillated cellulose, having a fiber length in the range of 200 to 10000 nm, or more preferably in the range of 200 to 700 nm, or even more preferably in the range of 200 to 500 nm.

The microfibrillated cellulose may be a never dried type of microfibrillated cellulose.

By the MFC being a never dried MFC it is possible to maintain all advantageous properties of the MFC such as high waster absorption capacity, high bonding capacity, high surface area, etc.

According to one embodiment of the second aspect the method further may comprise a step of running said wet web or sheet through a drying section of the paper machine with reduced or no drying.

According to yet an alternative of the second aspect an earth carbonate or at least one precursor thereof may be added to said stock suspension or to said wet web, in the forming section of the paper machine.

Thereby a composite or hybrid material between the microfibrillated cellulose and the alkaline earth carbonate may be formed, in that the carbonate is able to precipitate onto or into the fibrils of the MFC. The carbonate may preferably be a calcium carbonate. Further the carbonate or, preferably, the precursors thereof, in this case carbon dioxide and milk of lime, may be added in the manner disclosed in WO2011/110744 A1, i.e. through an in-line method, this allows for a very efficient and rapid formation of the precipitated calcium carbonate. Even further, the carbonate or precursor thereof may be added in nanoparticles, such that for instance a nanoPCC is formed onto or into the MFC fibrils.

According to another embodiment the method may further comprise a step of providing surface active agents or polymers to said wet web in step i), or by applying said surface active agents or polymers onto said wet web in step ii).

This means that the surface active agents or polymers may either be added in the wet end circulation or e.g. sprayed onto the initial wet web formed on the wire.

According to one alternative embodiment the temperature in the head box, in step i), may be >50° C., or more preferred >55° C., or even more preferred >60° C.

According to a third aspect of the present invention there is provided a wet laid sheet material obtainable by the method according to the second aspect.

According to a fifth aspect there is provided the use of a wet laid sheet material according to the first or third aspect for hygiene tissue applications.

By "hygiene tissue" is meant, but not excluding any other possible applications, wet wipes, washcloths, patches, towelettes, napkins, kitchen cleaning wipes, floor cleaning wipes, sanitary seat wipe, etc.

This means that the sheet may be used for applications such as wet wipes, such as baby wipes, cleansing pads, etc. optionally with added chemicals or active ingredients such as disinfectants, agents for pain relief etc. The MFC sheet is very difficult to dry out, and since the sheet material substantially only contains MFC and water, as the moisturizer, it is also advantageous from an allergy and environmental point of view. Further no additional chemicals or additives are needed to keep the sheet wet or moist.

Further as the sheet can be produced in a conventional paper making machine there types of tissues can be produced in a very cost efficient manner. Also the raw material MFC for the sheets, may be produced in a cost efficient manner through conventional means and processes.

This may also open up for new uses of these types of hygienic tissues, such as kitchen cleaning, floor and window cleaning and as water absorbing material.

The wet sheet is further flushable in the toilet, as opposed to for instance conventionally produced air laid wet wipes, and is also biodegradable.

Preferred features of each aspect of the invention are as for each of the other aspects mutatis mutandis. The prior art documents mentioned herein are incorporated to the fullest extent permitted by law. The invention is further described in the following examples with figures, which do not limit the scope of the invention in any way. Embodiments of the present invention are described as mentioned in more detail with the aid of examples of embodiments the only purpose of which is to illustrate the invention and are in no way intended to limit its extent.

BRIEF DESCRIPTION OF THE DRAWINGS

Embodiments of the present solution will now be described, by way of example, with reference to the accompanying schematic drawings in which:

FIGS. 1*a* and 1*b* are a schematic side views of a conventional paper making machine.

DESCRIPTION OF EMBODIMENTS

Figure 2:
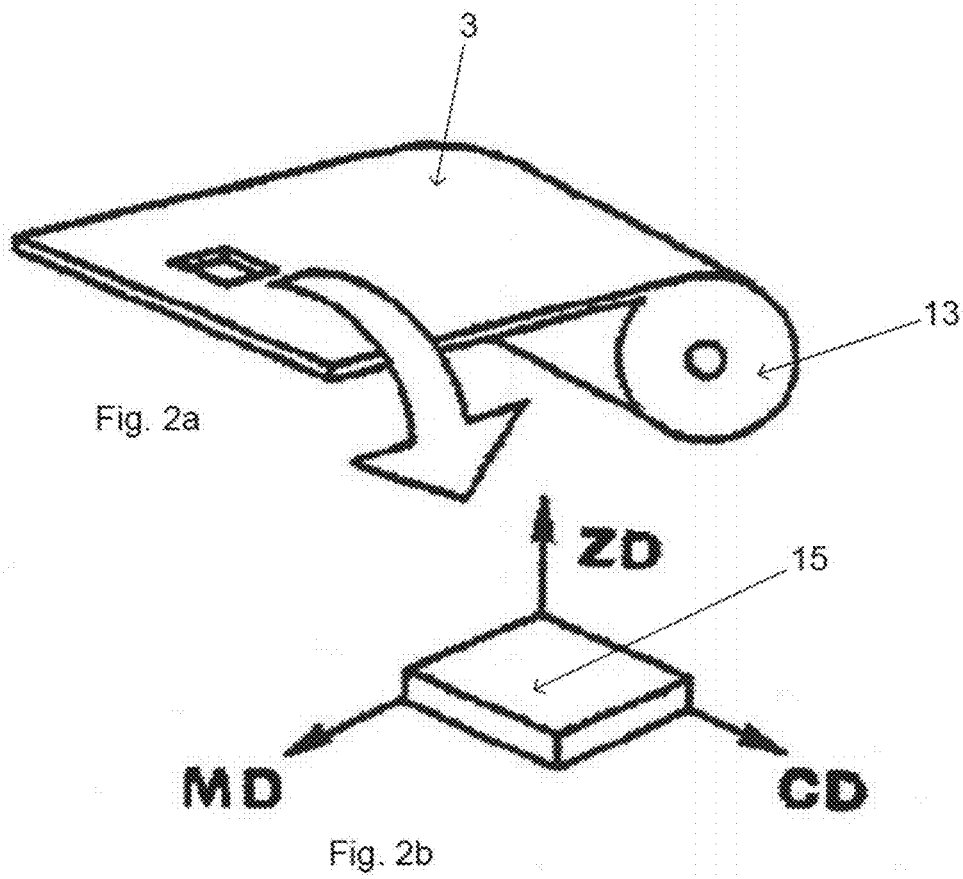
FIG. 2*a* is a schematic perspective view of a sheet rolled onto a reel.
FIG. 2*b* is a cut out portion of the sheet shown in FIG. 2*b* and showing tensile strength directions.

The fibrillated cellulosic material according to the present invention may according to one embodiment be a microfibrillated polysaccharide, such as a microfibrillated cellulose (MFC). MFC is a material typically made from wood cellulose fibers, both from hardwood or softwood fibers. It can also be made from microbial sources, agricultural fibers such as wheat straw pulp, bamboo, potato or other non-wood fiber sources and from recycled pulp or regenerated cellulose. In microfibrillated cellulose the individual microfibrils have been partly or totally detached from each other. A microfibrillated cellulose fibril is normally very thin (~20 nm) and according to the present invention the fiber length may be in the range of 200 to 10000 nm. The MFC may contain also larger fibrils and even fibers having a length up to 1 mm, i.e. a relatively coarse MFC material.

The microfibrillated polysaccharide may also be made from other biopolymers such as starch, peat, proteins, or even synthetic polymers. Biosources may contain cellulosic fibrils or then biomass can be dissolved in an appropriate solvent and e.g. spun to a fiber using melt- or electrospinning. It is also possible to make blends between different biopolymers in order to get improve strength properties such as in the case of cellulose and protein. Another possibility is to blend synthetic polymers with biopolymers which also solves problems with e.g. strength. The fibrils of the MFC may also be polymer coated or grafted or cross-linked fibrils, i.e. a modified fibril either chemically or physically.

In US20120090119 different types of fibers and filaments are disclosed, which could be included in the definition of microfibrillated material composition according to the present invention.

According to one embodiment this coating may be a calcium carbonate which has been precipitated onto and/or into the fibrils of the MFC. According to an alternative embodiment the coating comprises a nano-PCC formed onto the fibrils. Almost all PCC is made by direct carbonation of hydrated lime, known as the milk of lime process. The lime is slaked with water to form $Ca(OH)_2$ and in order to form the precipitated calcium carbonate (insoluble in water) the slaked lime is combined with the (captured) carbon dioxide. The PCC may then be used in paper industry as a filler or pigmentation agent. It can also be used as filler in plastics or as additive in home care products, tooth pastes, food, pharmaceuticals, paints, inks etc.

In the definition of PCC, other divalent metal ions can be used instead of Calcium ion when forming the crystals. One example is the use of Mg(OH)2 and carbon dioxide which forms the Magnesium carbonate. By "in-line production" is meant that the precipitated calcium carbonate (PCC) is produced directly into the flow of the paper making stock, i.e. the captured carbon dioxide is combined with slaked lime milk inline, instead of being produced separately from the paper making process. Separate production of PCC further requires the use of retention materials to have the PCC fastened, adhered or adsorbed to the fibers. The PCC may be added, or the precursors thereof rather in an in-line PCC process, which is generally recognized as providing a clean paper machine system, and there is a reduced need of other retention chemicals. An in-line PCC process is for instance disclosed in WO2011/110744.

In the in-line production the PCC is formed, not in the aqueous phase but preferably directly onto the fibrils of for instance microfibrillated cellulose. This means that the PCC may be very tightly bound to the microfibrillated cellulose and thus forming a PCC/MFC-composite material, instead of the PCC merely being admixed into the MFC suspension or slurry.

Other types of fillers such as bentonite, kaolin, talk, plastic pigment, CaCO3, color pigments, TiO2 etc. can be also used as a filler in the wet web.

The microfibrillated cellulose used in the present invention may also be a fractionated part, containing large part of long fibrils—thus giving large wet strength/and wet tear values, also normal fibers can be used as a component.

According to one embodiment the MFC may be a carboxymethylated or TEMPO oxidized, carbamated, enzymatically treated MFC.

According to another embodiment the sheet material may comprise super absorbent fibers such as cross linked MFC or cross linked CMC or a cross-linked polysaccharide.

In the present invention a so-called never dried microfibrillated cellulose is preferably used to form the web and sheet.

According to one alternative embodiment the microfibrillated cellulosic material may comprise different fractions of microfibrillated of e.g. microfibrillated cellulose, where at least one fraction is MFC have a coarse particle size, i.e. in the range of 0.2-1.0 mm.

Description of Sheet Forming

According to one embodiment the wet laid sheet according to the present disclosure may be produced in a conventional type of paper making machine. An example of such a paper machine 1 is shown in FIGS. 1*a* and 1*b*, where FIG. 1*b* is a continuation of FIG. 1*a*.

FIG. 1*a* illustrates a forming section 5 or the so called wet end of the paper making machine and a pressing or wet pressing section 6. In the head box 2 a stock solution or suspension 4 is usually provided and prepared. The stock solution 4 may for instance be heated to a desired temperature, or run through sieves to remove impurities etc. In the head box 2 different types of paper making additives or chemical aid may also be added to the stock solution, for instance, but not limited to additives such as retention chemicals, fillers and surface active agents or polymers.

Other types of additives that may be added in the wet end or size press may be additives such as starch, PVOH, CMC, or latex (SB, SA), cross-linkers, optical brighteners or colorants, biocides, fixatives, lubricants, preservatives, dispersants, etc.

According to one embodiment a stock suspension or solution containing at least 80% dry microfibrillated cellulose of the total fiber material weight is provided. According to alternative embodiments the stock suspension contains at least 90%, or even more preferred at least 95% or the most preferred at least 97% dry microfibrillated cellulose of the total fiber material weight. This means that the end product wet sheet may comprise at least 99%, or even as much as 100%, MFC in some cases, that means that the stock suspension according to this invention is not a conventional pulp suspension, but a "substantially pure" microfibrillated cellulose suspension. By "substantially pure" is meant that the suspension may contain or comprise other additives, chemicals or paper making aids as well or that it is free from other pulps, but may contain some other chemicals and additives.

Based on solids in the stock suspension the MFC content may be in the range of 20-65 wt.-% (i.e. percent of dry weight/wet weight), or more preferably in the range of 25-35 wt.-%. According to one embodiment the MFC content in the stock suspension may be about 35 wt.-%.

The stock suspension 4, containing microfibrillated cellulose, is provided onto a wire 3 in the forming section 5. A wet web 3 is thereby formed on the wire. An arrow 4 indicates the direction of the web or the machine direction.

After the forming section 5 the web passes through a pressing section 6, or a wet pressing section. The pressing operation may be performed by passing the wet web 3 through a series of nips, which are formed by rolls 7 pressing against each other, and are aided by press felts 8 which absorb the pressed water from the web.

After the wet pressing operation the web or sheet material 3, may be passed through a drying section 9. The drying may be performed in many different manners, but one way is to use drying cylinders 10 and steam. In the present application, little or no drying is performed, which is also illustrated in Example 1 below, where no steam was used in the drying cylinders. The web 3 thus remains wet or moist even after passing through the drying section 9. After the drying section 9 the web or sheet 3 may pass through a calender section and a series of calenders (heavy steel rolls) 12 to smooth the sheet, and finally rolled onto a roll or reel 13.

According to one embodiment of the above described method retention chemicals may be used.

According to another embodiment the web may be formed through foam forming technology and/or foam coating technology. Foam forming techniques are described in GB1,329,409, U.S. Pat. No. 4,443,297 and in WO96/020701. Foam forming may improve the solids content and dewatering in the wire or forming section.

According to yet an embodiment the initial tensile wet strength may be increased by using surface active agents or polymers with the MFC web. These surface active agents or polymers may preferably be added into the wet end circulation or applied, e.g. by spraying onto the web formed on the wire. The surface active agents or polymers may improve properties such as re-wetting and re-pulping of a dried MFC sheet, thus making it flushable.

According to yet another embodiment preservatives may be used in the web, such as those disclosed in US2009/0035340.

According to one embodiment dyed normal pulping fibers may be added to improve or alter the visual appearance of the wet sheet.

According to one embodiment the surface texture of the wet laid sheet may be modified, for instance by an imprinted knuckle pattern, one such technology is disclosed in U.S. Pat. No. 6,670,521.

The above described manner of producing the wet laid sheet according to the present invention should however not be interpreted as the only manner of producing the sheet without having to significantly adjust or rebuild and modify the machine.

According to another embodiment other variants of dewatering technologies, not limited to conventional ones, may be uses, e.g. e-dewatering.

Further it is possible to make the process scalable to 500-1800 m/min by altering the process parameters.

In US2012291974 a paper making method and system is disclosed where a pulp suspension having a high contents of nanofibrillated cellulose is run through the machine. In order to avoid detachment problems from the wire and to reduce dry shrinkage the machine has been modified to incorporate a long wire, such that the web is able to be run from the forming section to at least the pressing section on the same wire. No such modifications needs to be made in order to produce the present wet laid sheet containing only microfibrillated cellulose. Further US20122291974 does not disclose the production of a wet laid microfibrillated sheet product, but a dried paper product.

According to the invention it has been surprisingly found out that wet formed or laid MFC sheets have a very high initial wet strength which makes possible to handle wet MFC sheets similar way as normal paper. This makes possible to produce wet MFC paper in normal paper machine, when enabling a proper dewatering of the MFC.

It has further been surprisingly found that wet pressed MFC sheets can have relatively high solids such as >20%, and already at this solids content the wet web very strong, i.e. has a high initial wet tensile strength.

Flushing property is considered often as a problem, and different solutions for this has been proposed as disclosed in WO 02/085272. In moist conditions the wet MFC sheet can be readily re-pulped and flushed. However when the MFC sheet according to the present invention has dried the situation is different due to the formation of more hydrogen bonds, and the dry MFC sheet is thus not any more possible to repulp in easy way.

Normal wet wipes dry very fast and for this reasons some additives as disclosed in US 2011/0268777, showing for example modified xantan gum, polyether dimethicones, are typically used to maintain moisture for longer times. As MFC is typically a hydrophilic gel-like material, it is very hard to dry, it also maintains its moisture much better than normal paper. Thus it is beneficial property that wet MFC sheet keeps its moisture longer than normal wet wipe.

The water absorbing capacity in normal wet towelettes is usually very small or close to zero, but as MFC can absorb large amounts of water, absorbing property is still relatively good even with the wet laid MFC sheet according to the invention. As MFC is never dried during production process, absorbing property is maintained very well.

Further as MFC can be made to have very high open area, it has also very good "dirt" absorbing property compared to normal fibers due to its available surface.

Cellulose is generally not regarded as allergenic, and as MFC sheet does not need binders etc. the wet laid MFC sheet can be considered as extra safe from an allergy point of view.

Conventional wet towellettes have usually been bound with latex, PLA etc. type of binders which makes wet towelletes hard to biodegrade. The wet laid MFC sheet according to the present invention is made from pure cellulose, it is biodegradable as such.

As described above it has surprisingly been found that wet laid MFC sheets can be produce with conventional paper machines, which can make them very cost efficient and energy efficient to produce. This further opens of for the possibility to utilize existing machines for production of new type of products in huge quantities compared to dry or air formed materials. For markets where the cost is a major concern a roll type of wet MFC sheet material would be an ideal solution.

The wet laid sheet material according to the invention has a very high initial wet tensile strength.

The tensile strength of the sheet material may be measured in different directions as illustrated by FIGS. 2*a* and 2*b*. In FIG. 2*a* a sheet material 3 rolled onto a reel 13 is shown, and a cut out portion 15 is illustrated in FIG. 2*b*, also showing the machine direction MD, and the cross direction CD.

The wet laid sheet has an initial wet tensile strength in the range i.e. the tensile strength/dry grammage, which can be in the range of 2-30, or preferably in the range of 4-8 Nm/g in the machine direction and in the range of 3-20, or preferably in the range of 3-7) Nm/g in the cross direction.

The SR (Schopper-Riegler) value, i.e. the measurement of drainability of the wet web is usually in the range of 90 to 97. This means that since the SR value is extremely high (i.e. >80), the sheet is very resistant to dewatering, i.e. it takes a long time to dewater the sheet. Typical values for paper making kraft pulps lie in the range of 13-14 before refining and in the range of 22-30 after refining (ready for paper making).

Pulp having dewatering level of >70 SR is considered to be microfibrillated cellulose. Thus according to the present invention, the material used is microfibrillated cellulose having a SR value of more than 70, more preferably more than 80 and even more preferably more than 90.

According to yet an alternative other techniques for forming a wet sheet may be combined, such that e.g. a multiply layer sheet is produced, by forming one layer with the above described wet laid technique and then a subsequent layer or layers with other techniques such as e.g. spray or foam coating. The subsequent layer may be MFC or a composition containing MFC.

Since the wet web has such a high initial wet strength, it is possible to provide for on-line surface sizing or coating of chemicals which makes it possible to have a ready product at the end of the production line. Thus according to one embodiment low surface energy emulsions and chemicals such as rosin sizing may be added during the process.

EXAMPLES

Example 1

MFC from wet bleached pine was produced with conventional MFC production system. Examples of such systems are acid hydrolysis of cellulosic materials, e.g. disclosed in WO 2009021687 A1, or MFC suspension produced by enzymatic hydrolysis of Kraft pulp cellulose, e.g. disclosed in WO2011004300 A1, acid hydrolysis followed by high pressure homogenization, e.g. disclosed in US20100279019, or by any other means known to the skilled person. The microfibrils can thus be liberated from untreated or pre-treated fibers by using mechanical forces such as refiners, extruders, homogenizators or grinders. The concentration of MFC in such suspensions is usually about 1-6% and the remaining part is water. It is also possible to use ionic liquids to create microfibrillated cellulose.

In the present example the raw material was never dried bleached pine pulp, and enzymatically pre-treated. The measured SR value was >93 SR, i.e. extremely high.

A wet web was produced in a conventional pilot paper machine, with process modifications made compared to a normal paper making process.

Experimental Data:

- 50 g/m2 dry sheet weight (easily adjustable in machine)
- moisture content 30-45% (easily adjustable in machine)

as dewatering was difficult due to the high SR value of the MFC stock suspension some changes had to be done;

- white water temperature was increased to 70° C. (normally 40-45° C.)
- wire speed 10 m/min (normally 45-60 m/min)
- C-PAM (Cationic polyacrylamide) was used as a retention chemical (400-800 g/t)
  - wire retention was about 85%, which shows that some of fines goes through the wire wet pressing in 3 nip (all double felted)

- nip pressures 15 or 0/15 or 25/15 or 45 kN/m
- nip pressures had to be reduced due to crushing of the sheet (more water than the press felt can remove)

no steam was used in drying cylinders (thus no or very little drying occurred in the drying section)

value measured from wet MFC sheet was

- measured from wet sheet (after 4 weeks of production)
  - SR>92 (measured from wet sheet)
  - water retention values (200 mesh) 270%
- measured from dry sheet (air drying)
  - SR 13
  - water retention value (200 mesh) 92% stretch to break was in the range of 10-15% in machine direction (MD), 18-25% in cross direction (CD)

initial wet tensile strength in the range of 200-400 N/m in machine direction (MD), 180-350 N/m in cross direction (CD)

The stretch to break and strength in some extent can however be adjusted or effected with draws in wire/press/drying section.

The SR-number or value was measured using EN ISO 5267-1 standard procedure. The water retention value (WRV) was measured using SCAN-C 62 standard procedure.

The decrease in water retention values in the example above shows that the fiber bonding capacity of MFC decreases after drying, this shows the advantage of using a never dried MFC material for the wet laid sheet.

The moisture content in the material is defined as the weight loss when a sample is dried to constant weight at 105° C.±2° C. It is expressed as a percentage of the weight of the un-dried sample, and is measured by techniques know to the skilled person.

Practical testing of the wet laid sheet material:

A4 sheets were cut from wet web of MFC and packed into heat sealed aluminum foil bags/envelopes for subsequent testing (see below):

Test no. 1: Peeled an orange and then wiped hands afterwards. Hands felt clean and dry. At first I thought that the towelette might have been too dry, but no, it worked fine without leaving you with a wet skin which is usually the case with products of this kind.

Test no. 2: Wiping of hands after peeling shrimps. Result: Decent cleaning effect. One towellete was used but two had probably been needed to classify the result as excellent.

Test no. 3: Wiping of hands after lighting a fire with the help of old newspapers. Result: Decent cleaning effect. Two towelettes would have been needed for a perfect result. Or, if the towelette would have been slightly moister the result would surely have been better. This third towelette seemed a little drier than the first two, it might have dried a bit in the package.

Test no. 4: A wet sheet was dipped into water and then scaled again. Wet web was able to absorb about 120 g/m$^2$ of water. After this wet web maintained its original shape and handability.

Test No. 5:

A4 size wet sheet was taken and with that glass window was cleaned manually

Window looked visually dirty with lots of water droplet shaped of dirt's in it.

about area of 1 m$^2$ of class window as easily cleaned and dirt was collected to the wet sheet in which this was visually seen.

Window became visibly much more clean

The wet sheet was very easy and simply to use (no water or washing additives needed)

A feature noted while wiping the window was that there was no excess water coming out of the wet wipe, which typically case visual imperfections when excess (unclean) water is dried to the window surface Example 2

In the example below a 3 layer laminate of MFC (air dried) was produced and tested.

some water was sprayed to top of a glass plate 3 wet sheets (about 50 gsm each) were put on the surface of the plate, so that good contact with glass and wet sheets was gained.

Some minor pressure was used to ensure good contact between sheets, such that a laminate structure was obtained The laminate structure of the 3 sheets was dried very good contact with glass was maintained during drying and no or very minor drying shrinkage happened due to adhesion between glass and wet sheets very smooth and visually appealing surface and appearance of the surface was gained, which is expected also to be very good or close to perfect surface for printing it was possible with some force to peel off the 3 sheet laminate laminate copied texture of the glass plate perfectly with all minor details copied strength properties from the 3 sheet laminate was measured about 150 gsm tensile strength machine direction (md) 15 kN/m stretch at break (md) 2.5% tensile strength cross direction 12 kN/m stretch at break (cd) 3.5%

Uses of the Wet Formed Sheet

In the below several different uses of the wet laid sheet material according to the present invention will be discussed. These are in no way limiting the number of potential uses of said sheet.

As described above the wet sheet may be used in hygienic tissue applications, such as wet wipes for babies, for wiping floors, windows etc.

The wet sheet may also be used as a moisture preservative, e.g. it could be used as a moisturizing mask for facial applications, also, due to the fact that it is non-allergenic it is conceivable that the wet sheet could be used as a surgical wet wipe or bandage, possibly with additions of anti-infective agents or active agents for wound healing etc.

According to one alternative the wet sheet may contain metals, or metal ions, such as silver particles as disclosed in EP12711456.

The wet sheet could also be used as a moisture control sheet, for instance in food applications.

According to one embodiment several web webs can be attached together with water and pressure (as an alternative, latex, starch ext. additives can also be used) and then dried under tension to form MFC laminate. Uses for such a laminate may be package for carbonated drinks, where high strength and low stretch is needed, as a part of fiber based material, or as top or inside surface for different type of containers such as trays, plates, etc. The laminate may further be used for decorative surfaces, where good visual appearance and high surface strength is needed, i.e. decorative laminates.

According to another embodiment the laminate may be used for a gypsum board. Dried material can also be used in building and construction materials or as wind protection materials, having good water vapour permeability.

According to another embodiment the wet laid sheet material according to the present invention may be used as a material for core production. In normal cores; sometimes top of the core is produced from higher strength core board, for such this web roll material would be suitable, a process for a production of such cores is disclosed in US2004216853.

According to yet another embodiment the wet laid sheet material may be used in packaging applications such as in trays or in wrapping material.

According to yet another embodiment the wet laid sheet material may be used as a composite material. Plastic-like rigid objects have been produced from the sheet simply by putting wet webs/sheets on a mould and letting them dry, basically same way as glass fiber laminates are one. For further improving strength properties extra water and/or some latex or similar sizing additives may be used for improving fibril/fibril contacts and bonding.

According to another embodiment the wet laid sheet material may be used as a coating material, by compressing and heating under compression the wet web on the top of any material will produce opaque high strength surface. Also in this case some extra water and/or glue can be used for improving end product properties.

According to yet another embodiment the wet laid sheet material may be used for the production of trays and similar objects, as the wet web/sheet has stretch close to 20% and 10%, it may be possible to compress this into different shapes by drying under pressure several sheets—trays/plates/surfaces can be produced.

According to an alternative embodiment the wet laid sheet material may be used for the production of carton pallets, such as those disclosed in USD602675 or FI20021490 A, or for the production of profiles for protection, e.g. as disclosed in FI112623 B.

According to one embodiment the wet laid sheet material may be rolled onto rolls or reels 13, and thus be sold as a wet sheet to end customers for subsequent uses thereof.

According to yet an alternative the wet laid sheet material may be in a single ply or multi ply, or alternatively MFC could be used only in one ply or as a part in one ply.

The wet web may thus be provided to off-line converting, meaning that the wet web may be used for converting processes such as further drying in presence of other materials, production of cores, or gluing with other webs.

Example 3-5

Figure 3:
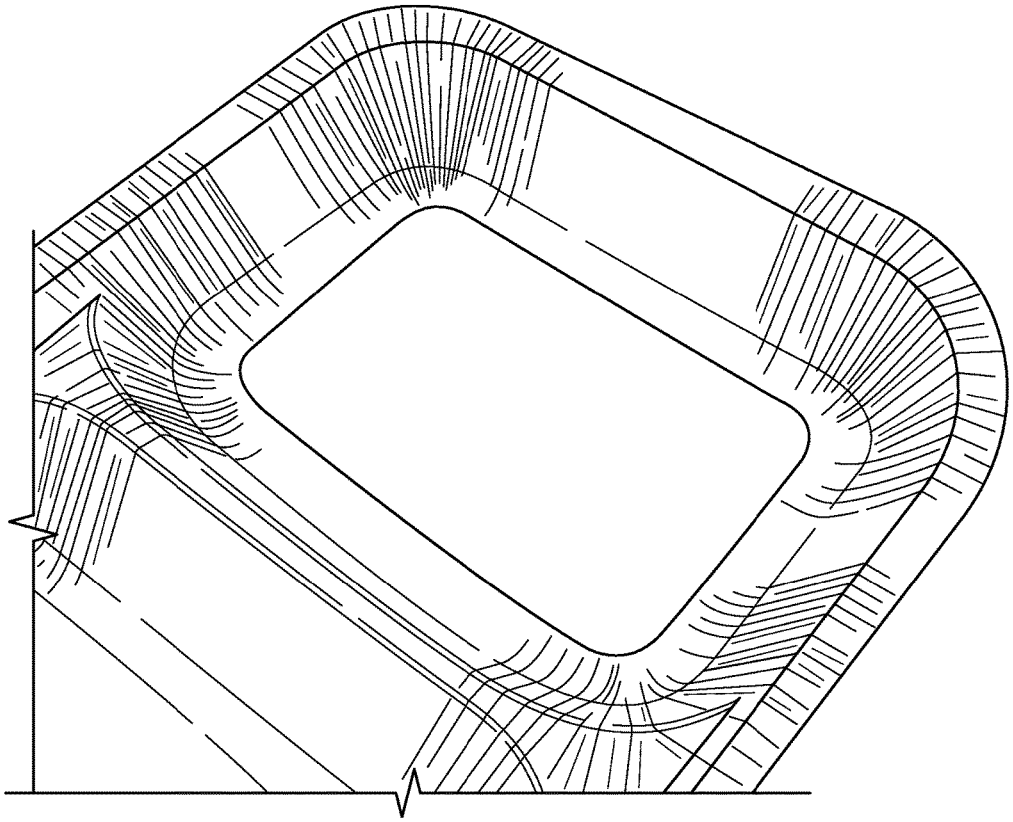
FIG. 3 shows a wet wipe pressed into form of a tray.
Figure 4:
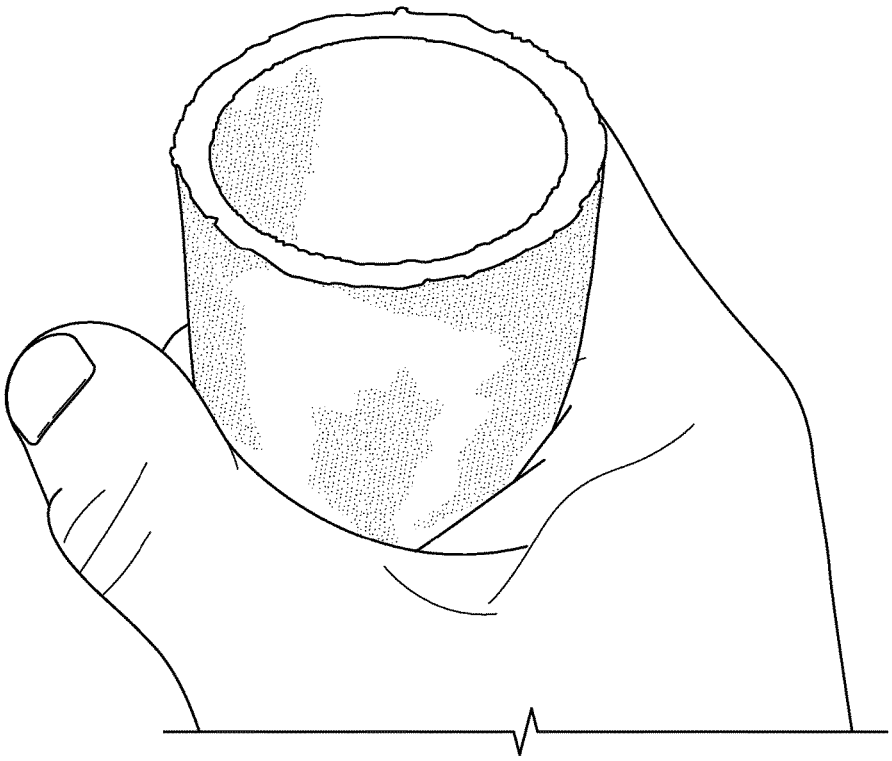
FIG. 4 shows a tube (core) formed from wet wipe.
Figure 5:
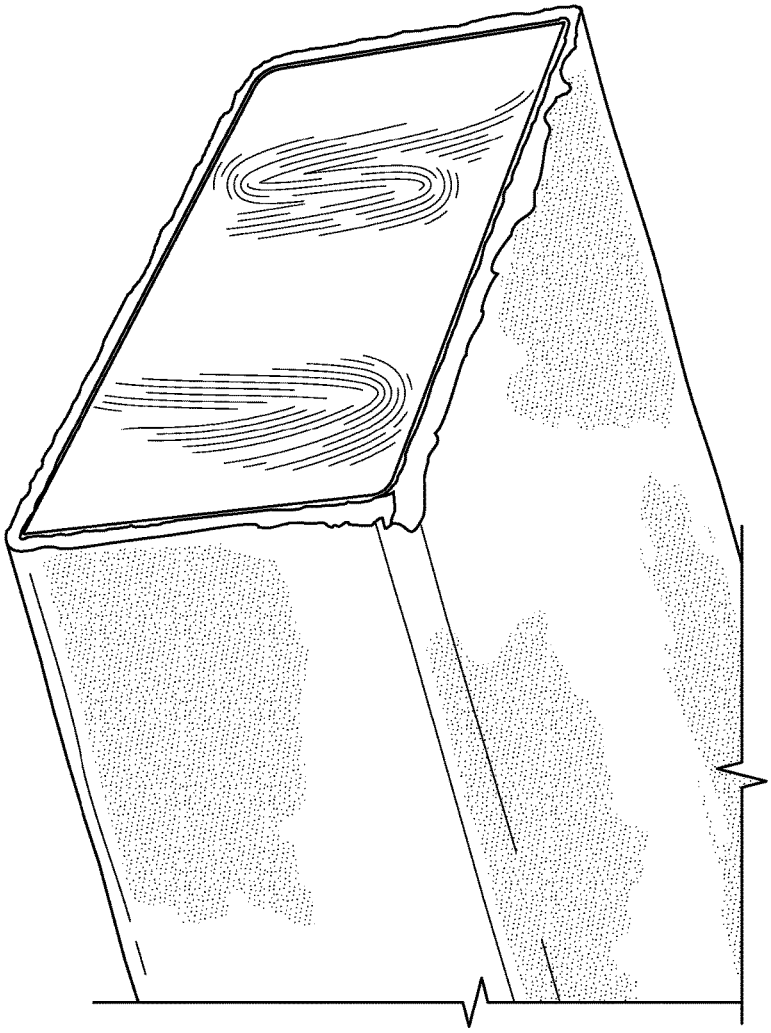
FIG. 5 shows a wet wipe was wrapped around a sawn piece of wood.

3) wet wipe pressed into form of a tray
   pressing done in wet/never dried form, because compression is hot >100° C., wet wipe will dry during pressing at take permanent shape
   due to large stretch to break, more difficult forms can be made (than from normal paper/board)
4) tube formed from wet wipe
   wet wipe was wrapped around a tube and allowed to dry
   extremely light weight and strong tube was produced
5) wet wipe was wrapped around a sawn piece of wood and let dry
   very nice surface, easy to paint surface was formed
   wet wipe was attached to the wood surface very well These examples 3-5 are reflected in FIGS. 3-5, respectively.

Various embodiments of the present invention have been described above but a person skilled in the art realizes further minor alterations, which would fall into the scope of the present invention. The breadth and scope of the present invention should not be limited by any of the above-described exemplary embodiments, but should be defined only in accordance with the following claims and their equivalents. For example, any of the above-noted methods or materials may be combined with other known methods or materials. Other aspects, advantages and modifications within the scope of the invention will be apparent to those skilled in the art to which the invention pertains.

The invention claimed is:

1. A wet laid sheet material comprising a fibrous web that contains >50% calculated as a dry microfibrillated material composition by weight of the total fiber material content in the web, wherein the microfibrillated material composition has a SR value of >70; and wherein the moisture content in the sheet material is >30 wt.-%.

2. The wet laid sheet material as claimed in claim 1, wherein the moisture content is >40 wt.-%.

3. The wet laid sheet material as claimed in claim 1, wherein the initial web contains >60% of calculated dry microfibrillated material composition by weight of the total fiber material content in the web.

4. The wet laid sheet material as claimed in claim 1, wherein the microfibrillated material composition comprises a microfibrillated polysaccharide.

5. The wet laid sheet as claimed in claim 4, wherein at least a portion of the microfibrillated material composition consists of a microfibrilliated polysaccharide or a microfibrillated cellulose, having a fiber length in the range of 200 to 10,000 nm.

6. The wet laid sheet as claimed in claim 1, wherein the microfibrillated material composition comprises microfibrillated cellulose.

7. The wet laid sheet as claimed in claim 6, wherein the microfibrillated cellulose is a never dried type of microfibrillated cellulose.

8. The wet laid sheet material as claimed in claim 1, wherein the sheet is formed in a paper making machine with reduced drying.

9. The wet laid sheet material as claimed in claim 8, wherein the web or sheet is formed in a paper making machine with substantially no drying.

10. The wet laid sheet material as claimed in claim 1, wherein at least one surface active agent or polymer has been added to the initial wet web.

11. The wet laid sheet material as claimed in claim 1, wherein an alkaline earth carbonate or precursor thereof is added into the web, such that the wet laid sheet material comprises microfibrillated cellulose and said alkaline earth carbonate.

12. The wet laid sheet material as claimed in claim 11, wherein the alkaline earth carbonate is a calcium carbonate and wherein the sheet comprises >30 wt.-% calcium carbonate.

13. A method of forming a wet laid sheet material from a wet fibrous web in a paper machine, wherein an initial wet fibrous web contains >65% dry microfibrillated material composition by weight of the total fiber material content in the web, wherein the microfibrillated material composition has an SR value of >70, and wherein the moisture content in the sheet material is >30%, the method comprising the steps of:

i) providing a stock suspension containing >65% dry microfibrillated material composition by weight of the total fiber material content in the suspension, in a head box of the paper machine;
ii) supplying said stock suspension onto a first wire in a forming section of the paper machine in such a way that the initial wet web is formed; and
iii) wet pressing said wet web in a press section of the paper machine, thereby forming said wet laid sheet material.

14. The method as claimed in claim 13, wherein the initial wet fibrous web contains >80% dry microfibrillated material composition by weight of the total fiber material content in the web, and wherein step i) comprises providing a stock suspension containing the corresponding amount of dry microfibrillated material composition by weight of the total fiber material content in the suspension.

15. The method as claimed in claim 13, wherein the moisture content in the sheet material is >40%.

16. The method as claimed in claim 13, wherein the microfibrillated material composition comprises microfibrillated polysaccharide.

17. The method as claimed in claim 16, wherein at least a portion of the microfibrillated material composition consists of a microfibrillated polysaccharide or a microfibrillated cellulose, having a fiber length in the range of 200 to 10,000 nm.

18. The method as claimed in claim 13, wherein the microfibrillated material composition comprises microfibrillated cellulose.

19. The method as claimed in claim 13, wherein the microfibrillated cellulose is a never dried type of microfibrillated cellulose.

20. The method as claimed in claim 13, further comprising a step of running said wet web or sheet through a drying section of the paper machine with reduced or no drying.

21. The method as claimed in claim 13, wherein an alkaline earth carbonate or at least one precursor thereof is added to said stock suspension or to said wet web, in the forming section of the paper machine.

22. The method as claimed in claim 13, further comprising a step of providing surface active agents or polymers to said wet web in step i), or by applying said surface active agents or polymers onto said wet web in step ii).

23. The method as claimed in claim 13, wherein in step i) the temperature in the head box is >50° C.

24. A wet laid sheet material obtainable by the method as claimed in claim 13.

* * * * *